United States Patent [19]

Seragnoli

[11] 3,967,767

[45] July 6, 1976

[54] DEVICE FOR SEVERING AND FEEDING FLACCID WRAPPING SHEETS

[75] Inventor: Enzo Seragnoli, Bologna, Italy

[73] Assignee: G. D Societa Per Azioni, Italy

[22] Filed: Dec. 2, 1974

[21] Appl. No.: 528,734

[30] Foreign Application Priority Data

Dec. 20, 1973 Italy ..... 3547/73

[52] U.S. Cl. ..... 225/96; 53/389; 225/100

[51] Int. Cl.[2] ..... B26F 3/02; B65H 35/10

[58] Field of Search ..... 53/228, 229, 230, 389; 225/96, 100; 83/176

[56] References Cited

UNITED STATES PATENTS

| | | | |
|---|---|---|---|
| 2,191,497 | 2/1940 | Potdevin et al. | 225/100 X |
| 2,247,069 | 6/1941 | Sargent et al. | 225/100 X |
| 2,279,843 | 4/1942 | Smith et al. | 53/389 X |
| 3,841,057 | 10/1974 | Engeler | 53/389 |

*Primary Examiner*—Robert L. Spruill
*Attorney, Agent, or Firm*—Robert E. Burns; Emmanuel J. Lobato; Bruce L. Adams

[57] ABSTRACT

A device for feeding wrapping material of flaccid type for use in a wrapping machine. Initially an elongate strip of the flaccid material is moved forward, and is only partly transversely cut to define sheets which can thereafter be torn from the strip. The sheets are left under control, as to their exact positions, until they are taken by the wrapping mechanism, along with the product to be wrapped. For this purpose the partly cut strip of flaccid wrapping material is guided and moved forward by rolls and guides which impress longitudinal strengthening ribs in the material. The strip is then engaged by sheet tearing and flattening rolls which have aligned, cylindrical surface portions rotating at a speed greater than that of the moving strip itself to detach successive sheets from the partly cut strip and to control each detached sheet as to its position until it is engaged with the product to be wrapped in it.

6 Claims, 7 Drawing Figures

DEVICE FOR SEVERING AND FEEDING FLACCID WRAPPING SHEETS

BACKGROUND OF THE INVENTION

This invention relates in general to the field concerning the infeeding of reel wound wrapping material to the wrapping mechanism of wrapping machines in the form of a succession of sheets or cuttings and, in particular, has as its subject a device for feeding material of the type known as flaccid transparent material to high speed wrapping machines.

DESCRIPTION OF THE PRIOR ART

Prior to the advent of flaccid materials for the wrapping or packing of various products, the devices for feeding sheets or cuttings of wrapping material to a wrapping machine drew advantage from the fact that the wrapping material possessed a certain degree of rigidity which prevented the sheet or cutting from curling or from getting out of place while being taken to the wrapping mechanism of the wrapping machine.

With the introduction into the product wrapping and packing industry of certain wrapping materials, such as, for example, reel wound polyethylene, the devices known in the art until that time were no longer able to guarantee, due to said materials being of the flaccid type, their being satisfactorily fed to the wrapping machines in sheet form, since the sheets tend to curl once they have been cut off the continuous strip.

In order to overcome the said difficulties derived from the use of the said flaccid type materials, certain types of devices were then designed to feed the materials so as to give them a crosswise undulation and thereby to create longitudinal strengthening ribs along, at least, the infeed path that extends from the position where the sheet or cutting is cut off the continuous strip up to the position where the said sheet or cutting is actually used on the wrapping machine. In other types a line for separating a sheet from a continuous strip was provided to make a discontinuous cut across the strip, whereafter the sheet was completely detached from the continuous strip by the product to be wrapped, when the sheet together with the product reached the zone in which the wrapping mechanism commenced its operation.

In practice it has been seen that the solution to the problem it was hoped to achieve has not been obtained either with the former or with the latter mentioned devices, particularly when used in conjunction with high unit output speed wrapping machines.

In fact, with the devices belonging to the first of the above mentioned types, what transpires is that the sheet or cutting is abandoned completely prior to it being taken, together with the product to be wrapped, by the wrapping mechanism of the wrapping machine. Thus it is unlikely that the sheet or cutting will be in the right position to suit the product to be wrapped. With the devices of the second type, trouble occurs because of the resistance the material offers when the previously only partly cut sheet or cutting is torn off by the product at the very moment when the wrapping mechanism takes hold of both the sheet and the product. Sometimes matters are made even worse as the partly cut sheet or the one following it, if not both, is torn instead of being simply detached, in consequence, for example, of there being flaws in the organic structure of the material, or due to accidental variations in the parts of the sheet not previously cut, or to other reasons still.

SUMMARY OF THE INVENTION

The object of the present invention is, therefore, to provide a device of the aforementioned type for the use specified, on which the sheet or cutting of wrapping material is kept under constant control right from the outset up until the time it is taken by the wrapping mechanism of the wrapping machine, along with the product to be wrapped.

Another object of the present invention is to provide a device able to attain the object mentioned above with a structure such that a high rhythm of succession be possible when infeeding the sheets or cuttings, with them being constantly kept under control.

These and other objects too have all been attained by combining, in the device forming the subject of the present invention, guide means for guiding a strip of flaccid wrapping material towards a utilization point or area means for causing the strip of wrapping material to move forward intermittently or in steps along the guide means; cutting means placed alongside the guide means for rhythmically partially transversely cutting the strip of wrapping material; means in, the guide means and/or forward movement means for alternately providing the strip with longitudinal strengthening ribs but disposing it for ultimate return to flat form; and a pair of sheet-tearing rolls positioned on opposite sides of the strip of wrapping material, below the cutting means but above the utilization point, having surface portions rotatable a speed greater than that of the wrapping material itself; these latter rolls being so shaped that they intermittently firstly detach from the strip the previously only partly cut sheet or cutting, and then retain the sheet or cutting until the time of its impact with the product and of its being taken, along with the product, by the wrapping mechanism.

BRIEF DESCRIPTION OF THE DRAWINGS

Further characteristics and advantages will emerge more clearly from the following detailed description of a preferred but not the sole form of embodiment for the device according to the invention, illustrated purely as an example on the accompanying drawings in which.

DESCRIPTION OF THE PREFERRED EMBODIMENT

Figure 1:
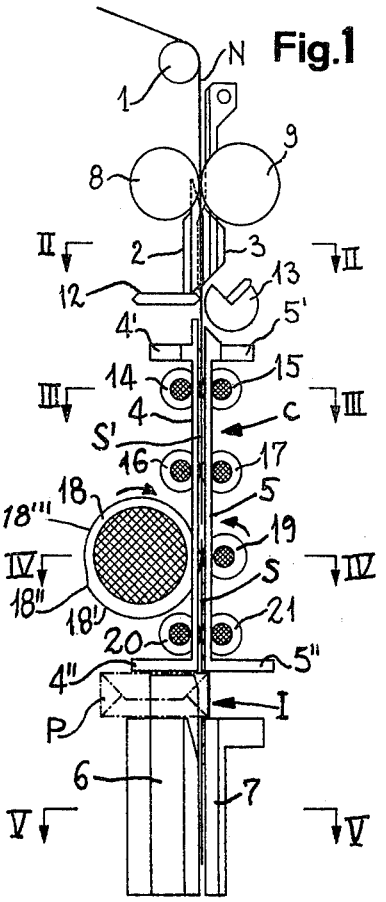
FIG. 1 diagrammatically shows a vertical cross sectional view of the new device.
Figure 7:
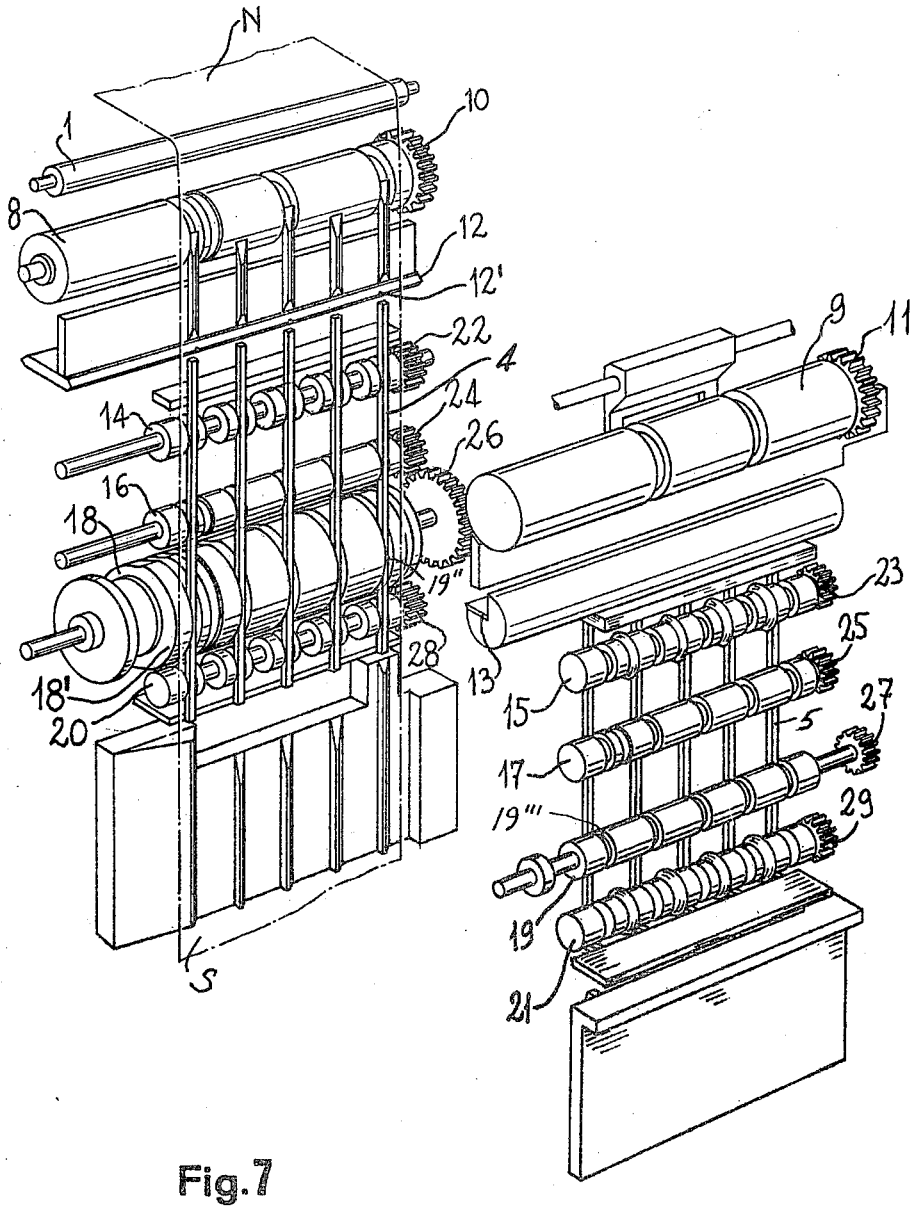
FIG. 7 shows the new device in an exploded perspective view.

With reference to the above mentioned figures and, in particular, to FIGS. 1 and 7, the device comprises a track or channel C for infeeding a strip N of wrapping material of what is known as a flaccid or limp, often transparent type, taken from a reel not illustrated in the figures. Strip N passes onto a vertical track or channel C over an idle roller 1 toward a wrapping position I at which products P to be wrapped arrive, in any known manner, with a certain frequency.

Figure 5:
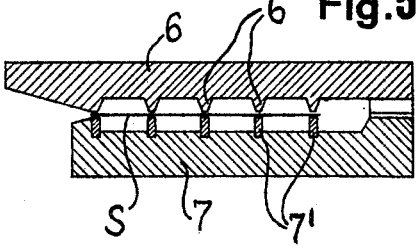

The track or channel C is fundamentally defined by two opposite sets of rod shaped members, between the idle roller 1 and the wrapping position I. More particularly the track is made up of two plates 2 and 3 positioned opposite each other and provided with staggered, vertical ribs 2′ and 3′ therebetween and thereon (see FIG. 2), and of two opposite sets of vertical rods 4 and 5, having opposite end portions 4′–4″ and 5′–5″, respectively (see FIGS. 1 and 7). Below the wrapping position I, the track or channel C continues and is made up of two plates 6 and 7 provided with opposite ribs 6′ and 7′, respectively (see FIG. 5).

Figure 2:
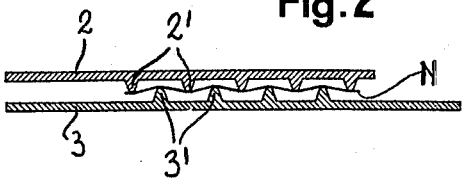
FIGS. 2, 3, 4 and 5 show horizontal sectional views of the device, taken respectively along the lines II—II, III—III, IV—IV and V—V in FIG. 1.

The staggered opposite ribs 2′ and 3′ of the plates 2 and 3 are dimensioned transversely in such a way that the edges of the ribs on one side penetrate beyond the plane of the strip N, between the ribs on the opposite side, the purpose of this being to give the strip of wrapping material a crosswise undulation so as to provide it with longitudinal strengthening ribs (see FIG. 2). The strip then moves along the two sets of opposite rods 4 and 5 and the ribs 6′ and 7′ belonging to the plates 6 and 7, respectively. In contrast to the edges of the preceding ribs 2′, 3′, the rods 4, 5 and ribs 6′, 7′ are spaced slightly apart from each other (see FIGS. 4 and 5) to enable the strip of wrapping material N to move freely downwards. In the latter downward movements, the flaccid strip and sheet material is free to resume its initial, flat configuration, as will be described. Thus the strip is alternately transversely undulated to provide it with longitudinal ribs, and enabled to resume its flat shape.

At a point corresponding to where the plates 2 and 3 are positioned there are a pair of feed rolls 8 and 9 which mate with each other through gears 10 and 11 (see FIG. 7). These rolls, driven with an intermittent motion in a conventional way, cause the strip N to be dragged toward them and pushed away from them, along the channel C. Immediately below plates 2 and 3 there is a stationary knife 12 and a rotatable knife 13, the latter being powered by suitable means (not shown).

Between the end plates 4′ and 5′ and 4″ and 5″ of the rod shaped members 4 and 5 four pairs of strip feeding and manipulating rolls 14, 15; 16, 17; 18, 19 and 20, 21 are provided and these pairs mate through suitably driven gears 22, 23; 24, 25; 26, 27, and 28, 29, respectively (see FIG. 7). Every roll in these pairs of rolls (FIGS. 3, 4) has annular grooves or races 14′ in which the rod shaped members 4 and 5 extend freely housed. In addition, every roll other than 18, 19 has annular projections 14″ in addition to the aforementioned grooves or races 14′, these grooves and projections being shaped in such a way as to generate longitudinal strengthening ribs in the strip (see FIG. 3). Roll 18 in the pair 18, 19 is shaped in cross sectional form with an irregular profile including an arcuate 18′ with a greater radial extension; the purpose of this will be described below.

The roll 18 is mounted on its rotation shaft in an angularly adjustable fashion.

Figure 6:
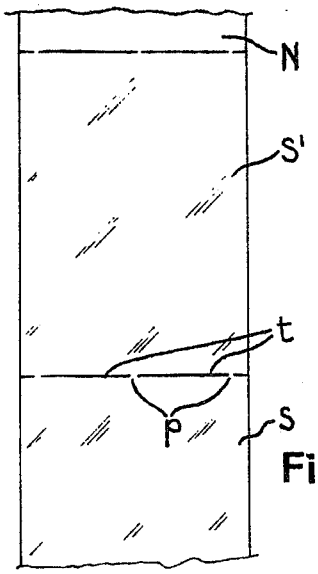
FIG. 6 shows, seen from the front, a section of material in strip form, with partial or discontinuous cutting lines running across it to define successive sheets or pieces of wrapping material.

The profile or cutting edge of the stationary knife 12 has interruptions or notches in it at a plurality of points 12′ (see FIG. 7), as also described in Italian Pat. No. 746,977 in the name of the assignees hereof. The conformation of the ensuing rolls 14, 15; 16, 17 and 20, 21, as well as that of the preceding ribbed plates 2 and 3, is such as to give the infed strip of wrapping material N a crosswise undulation. This combination of features, as also indicated in the early part of this description, is provided to strengthen the flaccid material; at the same time to keep it in form of a coherent strip N, until sheet S is torn off by rolls 18, 19; and to hold this sheet in proper position even after the tearing off. The above described device operates in the following way: The strip N of flaccid transparent material is made to move forward intermittently by the rolls 8 and 9 in between the plates 2 and 3 where it is ribbed longitudinally in order to reenforce the strip against bending moments which would otherwise induce curling, as already explained, and thus to facilitate its moving downward along the track or channel C. At the exit from the plates 2 and 3, the strip N is no longer acted upon by ribs 2′, 3′ of these plates, as will be clear from FIGS. 1 and 2, therefore it resumes its normal, transverse, by flat configuration and position, prior to passing in between the knives 12 and 13, which cut it transversely, this configuration being shown in FIGS. 1, 4 and 5. The knives cut the strip in a discontinuous fashion as shown at t, due to the interruptions 12′ in the stationary knife 12, in such a way as to partially define a boundary or edge of a sheet or cutting S without, however, detaching it from the strip N to which it remains joined at the points p (FIG. 6). This operation is also described in the above mentioned Patent.

Figure 3:
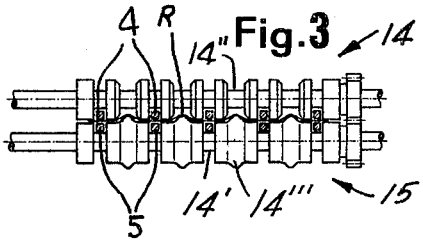
Figure 4:
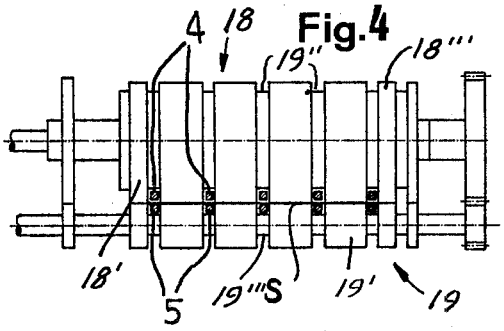

Below the aforementioned knives, the strip N passes downwards between the rod shaped members 4 and 5 and goes in between the pairs of roll 14–15 and 16–17 which again rib it longitudinally, as shown in FIG. 3 at R. Thereafter the strip again assumes its normal, flat, transversely extended form. It then passes between surfaces 18′, 19′of the pair of rolls 18–19, as shown in FIGS. 4 and 7. Here the guiding rods 4 and 5 extend through grooves 19″, 19‴ of the rolls 18, 19, as shown. Finally the sheet S, torn off from the strip N by the rolls 18, 19 as already mentioned, passes through the pair of rolls 20–21 where it is ribbed once more to facilitate its downward movement in between the plates 6 and 7 below the wrapping position I, in front of product P. It will be understood that this product then performs a horizontal movement, and thereby a sheet-folding operation, an initial phase of which is shown in FIG. 1.

While the downward movement of the strip N toward plates 6 and 7 is taking place, the strip is brought into contact with the roll 19 by an intermediate portion 18″ between the two areas 18′, 18″ which have different radial extensions of the roll 18. The contact of the strip with the intermediate area 18″ increases the surface speed the strip, thereby causing the roll 18 to firstly detach the sheet or cutting S along the cuts *t*, by tearing the points p holding it to the strip N (see FIG. 6) and then to keep the sheet S taut with the long-radius area 18′ until the sheet is engaged by the product P to be wrapped at the entrance point to the aforementioned wrapping position I, against the edges of the plates 5″ and 7 which delimitate this entrance.

At that moment the sheet or cutting S is released by the area 18′ of the roller 18 because of the arrival of the arcuate surface 18‴ with a minor radial extension; this still enables the sheet S to move downwards (see FIG. 1) as it encounter product P.

It is thus obvious that the sheet or cutting S has fully been restrained, up until its impact on the product P at the edges of the plates 6, 7, to hold the sheet in its correct wrapping position with respect to the product P. For this purpose the strip and sheet have constantly been kept under control, in accordance with the preceding description.

What is claimed is:

1. Apparatus for feeding flaccid sheet material, comprising;

a channel having surfaces disposed to contact surfaces of an elongate strip of flaccid sheet material and to guide said strip toward a zone of utilization, the channel having feed rolls to feed the strip to said zone, the channel surfaces and feed rolls generally defining a plane of travel for the strip and having means in a channel section upstream of said zone for removably impressing longitudinally extending, transversely spaced ribs in the strip to strengthen the flaccid material against curling;

a cutter disposed adjacent said channel, upstream of said channel section, for making transverse perforations in the strip, in synchronism with the feeding of the strip, and for thereby partly defining successive sheets which constitute parts of the strip, but leaving the sheets interconnected at spaced points; and a pair of rolls positioned on opposite sides of said channel and engaging the strip, said pair of rolls having means for tearing the successive sheets from the engaged, perforated strip and for moving them to the zone of utilization while preventing displacement of any detached sheet from the lateral orientation relative to the channel in which the sheet, as part of the perforated strip, was engaged by the pair of rolls.

2. Apparatus according to claim 1 in which the surface of one of the rolls of said pair has a first arcuate surface portion of relatively long radius, a second one of relatively short radius, and a third and intermediate surface portion, the first and third portions having engagement with a surface of the other roll of the pair, through the flaccid material; the intermediate portion being disposed by its said engagement to move the portion of the strip, engaged thereby, along the channel more rapidly than the strip is fed by said feed rolls, and thereby to effect the tearing off of successive sheets at said spaced points and the area of long radius being disposed by its said engagement to effect the moving of the sheets to the zone of utilization and the preventing of displacement of a sheet from its lateral orientation.

3. Apparatus according to claim 2 in which the rolls of said pair have annular grooves opposite one another, the channel including pairs of rods extending longitudinally of the channel into and tangentially through said grooves to guide the sheet between the rolls of said pair.

4. Apparatus according to claim 3 in which the feed rolls of the channel include pairs of mutually opposite feed rolls in said channel section, having mutually mating grooved and enlarged surface portions for the impressing of ribs in the strip, said rods extending from the grooves of the rolls of said pair into said channel section and being disposed in said section to cooperate with the feed rolls in said impressing of ribs.

5. Apparatus according to claim 1 in which said channel is vertical.

6. Apparatus according to claim 1 in which said channel has an additional channel section, upstream of said cutter, disposed to removably impress longitudinally extending, transversely spaced ribs in the strip for strengthening the flaccid material of the strip, where it is fed to said cutter, against bending moments which tend to curl the strip out of said plane.

* * * * *